US007464431B2

(12) United States Patent
Stevens

(10) Patent No.: US 7,464,431 B2
(45) Date of Patent: Dec. 16, 2008

(54) PAINT BRUSH

(76) Inventor: Dale Stevens, 11626 Vicary Rd., Horton, MI (US) 49246

( * ) Notice: Subject to any disclaimer, the term of this patent is extended or adjusted under 35 U.S.C. 154(b) by 178 days.

(21) Appl. No.: 11/524,110

(22) Filed: Sep. 20, 2006

(65) Prior Publication Data

US 2008/0066253 A1 Mar. 20, 2008

(51) Int. Cl.
*A46B 11/00* (2006.01)

(52) U.S. Cl. ..... 15/205.2; 15/160; 15/248.1; 401/15

(58) Field of Classification Search ..... 15/160, 15/168, 169, 246, 248.1, 205.2; 401/15, 401/270, 282, 289
See application file for complete search history.

(56) References Cited

U.S. PATENT DOCUMENTS

| | | | | |
|---|---|---|---|---|
| 3,130,434 | A | 4/1964 | Daw | |
| 3,153,801 | A | 10/1964 | Weiss et al. | |
| 3,155,998 | A | 11/1964 | Hardman et al. | |
| 3,172,141 | A | 3/1965 | Arena | |
| 3,192,549 | A | 7/1965 | Weiss et al. | |
| 3,231,920 | A | 2/1966 | Malpas | |
| 3,332,102 | A | 7/1967 | Brinker | |
| 3,603,694 | A | 9/1971 | Hamm | |
| 3,897,603 | A | 8/1975 | Brennenstuhl | |
| 3,933,415 | A | 1/1976 | Woolpert | |
| 4,494,268 | A | 1/1985 | Chu | |
| 4,641,673 | A | 2/1987 | Conley et al. | |
| 5,398,365 | A * | 3/1995 | MacKenzie | 15/160 |
| 6,082,921 | A * | 7/2000 | Caldwell | 401/287 |
| 6,213,667 | B1 * | 4/2001 | Isaac | 401/289 |
| 6,779,535 | B2 | 8/2004 | Drukarov | |
| 2002/0004963 | A1 * | 1/2002 | Woodnorth et al. | 15/160 |
| 2005/0198759 | A1 * | 9/2005 | Segrea | 15/176.1 |
| 2007/0098482 | A1 * | 5/2007 | Wang | 401/205 |
| 2008/0056802 | A1 * | 3/2008 | Baghdoian | 401/45 |

* cited by examiner

*Primary Examiner*—Eileen P. Morgan
(74) *Attorney, Agent, or Firm*—Young Basile

(57) ABSTRACT

A drip-reducing paint brush having a hollow handle and a flared perimeter around the area where the paint applying element is attached to the brush so that excess paint from a pad or bristle bundle flows into the interior of the handle where it is contained rather than over the outside of the handle where it poses a problem to the user. An auxiliary containment device may be threadedly attached to the hollow handle.

8 Claims, 2 Drawing Sheets

PAINT BRUSH

FIELD OF THE INVENTION

My invention relates to paint brushes and more particularly to a brush which is constructed to contain excess paint from the paint applying element, i.e., bristle bundle or pad, when the brush is being used in an inverted position, thereby minimizing dripage.

BACKGROUND OF THE INVENTION

Painting by brush, rather than by roller, is necessary in many situations. One of the most common situations is painting a ceiling or some other structure which requires the brush to be used in an inverted position with the paint applying element higher than the handle. The problem here is that excess paint from the paint applying element tends to flow by gravity and/or capillary action back toward the handle. Eventually paint runs down the handle toward the user. This effect can be minimized by picking up only very small amounts of paint onto the paint applying element, but this tends to lengthen or drag out an already somewhat tedious process.

SUMMARY OF THE INVENTION

My invention is a brush which essentially solves the problem of paint dripage when the brush is used in an inverted position wherein the paint applying element is higher than the brush handle. In general I accomplish the objective of my invention by (a) creating a containment volume within the handle of the brush and (b) designing a flared periphery into the portion of the brush handle body which receives and surrounds the paint applying element. Thus, excess paint flows into the containment volume rather than down the outside of the handle.

In an optional embodiment of my invention, I enhance or increase the capacity of the paint-containing volume provided by the hollow handle by adding a small auxiliary container which, in the preferred form, is threaded into the distal end of the paint brush handle, so as to be in flow communication with the containment volume within the handle itself.

DETAILED DESCRIPTION OF AN ILLUSTRATIVE EMBODIMENT

Figure 1:
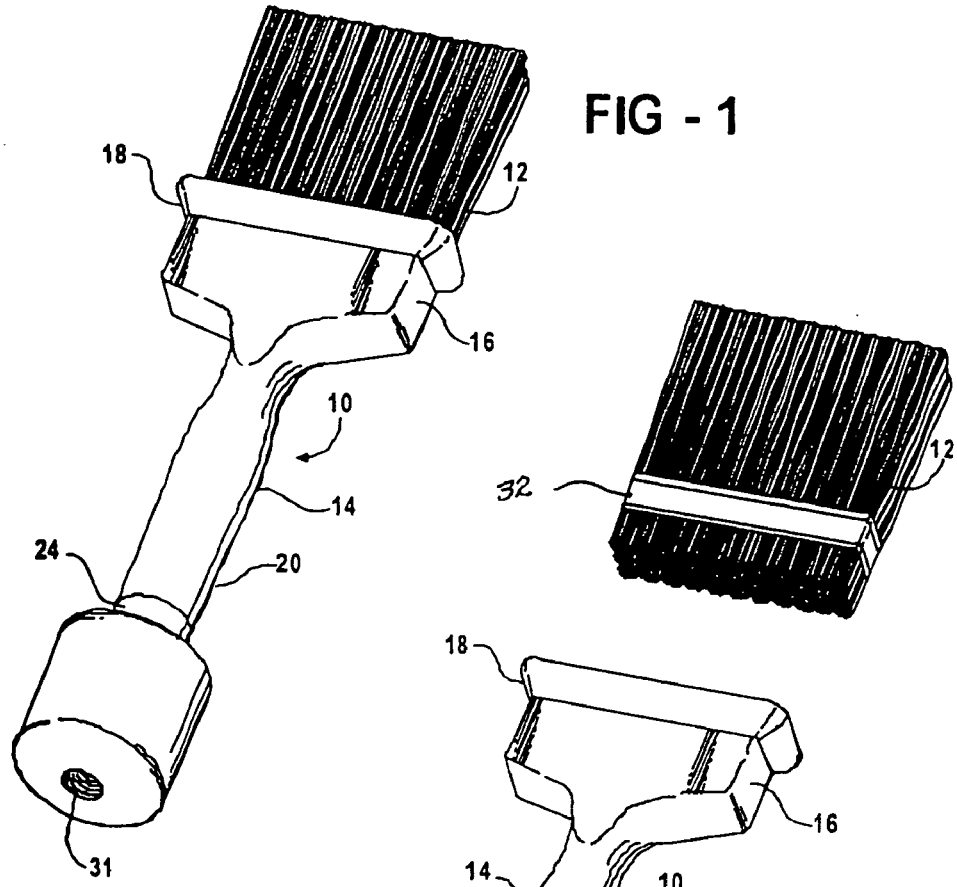
FIG. 1 is a perspective view of an illustrative embodiment of the invention using a bristle bundle.
Figure 2:
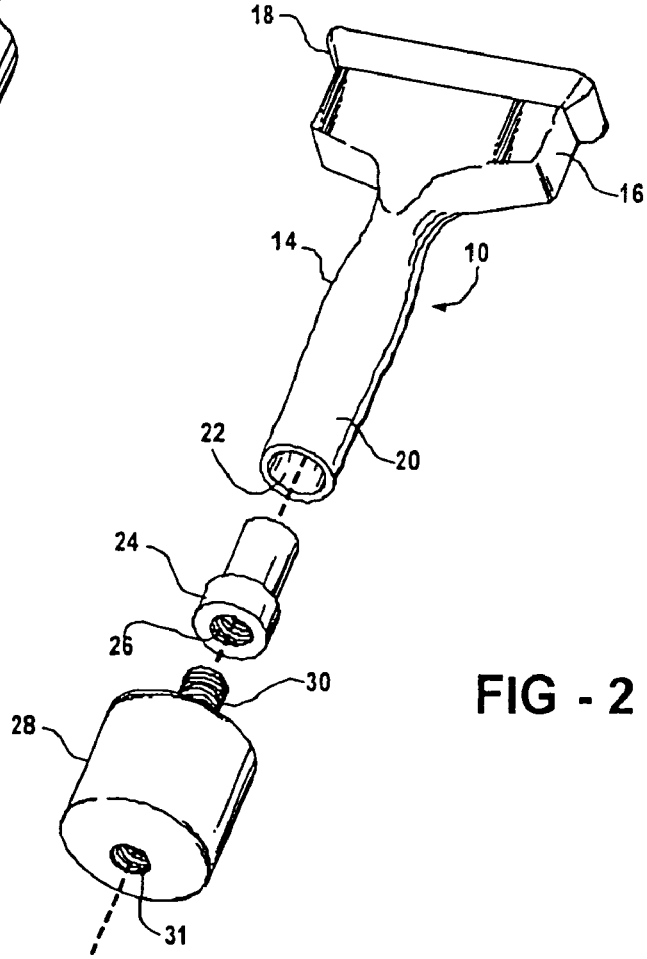
FIG. 2 is an exploded view of the embodiment of FIG. 1 also in perspective.
Figure 3:
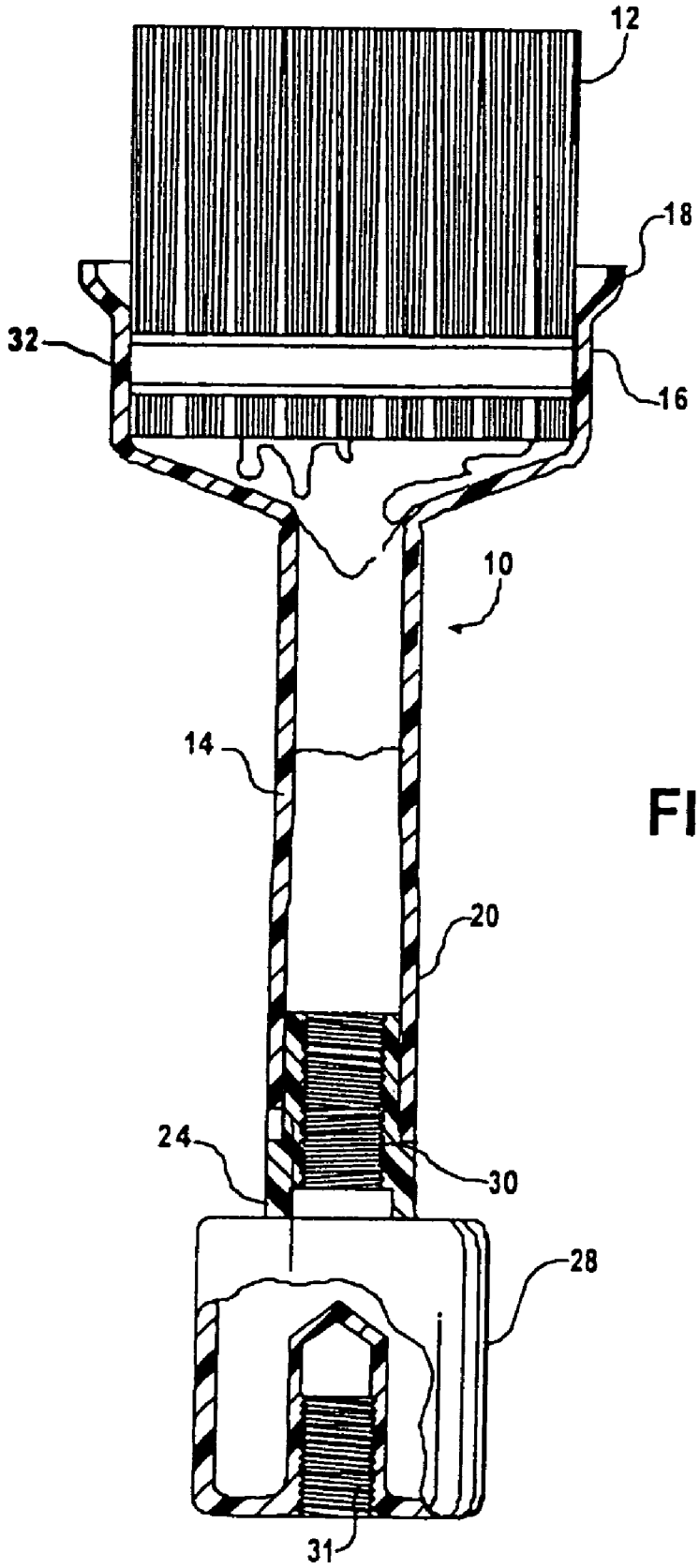
FIG. 3 is a cross-sectional view of the brush of FIGS. 1 and 2.

Referring to the figures, a paint brush 10 comprises a paint applying element in the form of a bristle bundle 12 set into a rigid plastic paint brush body 14. The body 14 has a first portion 16 which is configured to receive and hold the bristle bundle 12 and is characterized by a flared perimeter 18 around the end opening into which the bristle bundle 12 is inserted. The brush body 14 further comprises an elongate hollow handle or gripping portion 20 defining an interior containment volume 22 for excess paint as hereinafter described.

In the illustrative embodiment, a stepped cylindrical insert 24 made of plastic or other rigid material and having an axial bore 26 is friction fit into the end opening of the gripping portion 20 and provided with interior threads 26 to receive an auxiliary paint container 28 having a threaded stem 30 to fit into the threaded bore 26 of the insert 24. The insert may be adhesively bonded into the gripping portion 20 of the brush handle 14 if desired. The threaded connection 26, 30 is provided such that the container 28 may be removed for cleaning. The container has a threaded end opening 31 which permits the attachment of an extension arm.

The bundle 12 is banded as shown at 32 but is not capped. This allows paint to move through the interior of the bristles from one end to the other. If the brush 10 is held in an inverted position with the bundle 12 higher than the handle 20, excess paint tends to gravitate and/or move by capillary action toward the brush handle 14. Rather than drip over the outside of the brush handle as is the case in conventional devices, the flared perimeter 18 catches the excess paint and directs it into the hollow interior 22 of the brush handle. When sufficient paint has accumulated during an inverted brushing process, the paint may also flow into the auxiliary container 28. This paint may actually be released back into the pad 12 by turning the brush into the normal position wherein the handle 14 is higher than the pad 12.

It will be appreciated that the paint-applying element 12 may be an open-cell porous pad as well as bristle bundle. The pad must be open cell to allow paint to flow internally into the containment volume of bundle 14 when the brush is inverted.

It will be understood that the embodiment illustrated herein insofar as proportions, configuration and construction details are concerned is illustrative or exemplary rather than limiting in nature and that various changes and additions will be apparent to those of ordinary skill in the art.

What is claimed is:

1. A paint brush comprising:

a paint-applying element;

a rigid body having an integral element-receiving portion and, integral therewith, a handle portion;

said element-receiving portion having an end opening into which the element is set and a flared perimeter about the opening providing a paint-catching space around the element;

said receiving and handle portions being constructed to provide a hollow interior in fluid communication with said end opening therethrough which acts as a containment volume for paint flowing from the element and captured in said space when the brush is held with the element above the handle portion.

2. The paint brush described in claim 1 wherein the element is a bristle bundle.

3. A paint brush as described in claim 1 wherein the element receiving portion is substantially rectangular in cross section.

4. A paint brush as described in claim 1 wherein the hollow interior extends to an end of the handle portion opposite the element receiving portion;

said brush further comprising an auxiliary container removably attached to said opposite handle end and in fluid communication with the hollow interior to increase the containment volume.

5. A paint brush as described in claim 4 wherein the container is threadedly attachable to the rigid body.

6. A paint brush as described in claim 5 further including a threaded hollow insert disposed between the container and handle portion and providing flow communication therebetween.

7. A paint brush as defined in claim 1 wherein the bristle bundle is banded.

8. A paint brush comprising:

a generally rectangular bristle bundle;

a rigid body having an elongate essentially tubular handle portion integral with a generally rectangular bristle receiving portion having an open end which is flared outwardly to create a clearance between the open end and the bristle bundle when installed in said opening; the generally rectangular portion and the elongate tubular portion being hollow and in continuous fluid communication with the clearance around the bustle bundle to catch and capture excess paint from the bristle bundle when the brush is used in a substantially inverted orientation.

* * * * *